US005651611A

United States Patent [19]

Weiler

[11] Patent Number: 5,651,611

[45] Date of Patent: Jul. 29, 1997

[54] SHADOW MASK ASSEMBLY FOR DENTAL LIGHT

[75] Inventor: Stephen N. Weiler, Newberg, Oreg.

[73] Assignee: A-dec, Inc., Newberg, Oreg.

[21] Appl. No.: 417,759

[22] Filed: Apr. 6, 1995

[51] Int. Cl.[6] ..... F21V 7/00

[52] U.S. Cl. ..... 362/303; 362/433; 362/444; 362/804

[58] Field of Search ..... 362/303, 433, 362/444, 445, 454, 804, 353, 358

[56] References Cited

U.S. PATENT DOCUMENTS

| | | | |
|---|---|---|---|
| 2,710,339 | 6/1955 | Targosh | 362/353 |
| 3,486,019 | 12/1969 | Bryant et al. | 362/303 |
| 4,987,521 | 1/1991 | Fratty et al. | 362/303 |
| 5,428,517 | 6/1995 | Behringr | 362/804 |

FOREIGN PATENT DOCUMENTS

| | | | |
|---|---|---|---|
| 365534 | 12/1938 | Italy | 362/444 |

*Primary Examiner*—Ira S. Lazarus
*Assistant Examiner*—Alfred Basichas
*Attorney, Agent, or Firm*—Klarquist Sparkman Campbell Leigh & Whinston, LLP

[57] ABSTRACT

The mask has a cap from which two deformable legs protrude. The legs are deformed to permit the outermost parts of the legs to be snapped into a groove in the socket that carries the lamp of the dental light. The mask is not attached to a reflector shield, thereby simplifying the manufacture of the overall lamp.

8 Claims, 2 Drawing Sheets

SHADOW MASK ASSEMBLY FOR DENTAL LIGHT

TECHNICAL FIELD

This invention relates to a mask that is connected to a dental light and arranged to cast a shadow over the eyes of the dental patient when the light is directed to illuminate the mouth of the patient.

BACKGROUND INFORMATION AND SUMMARY OF THE INVENTION

Proper illumination of a dental patient's mouth is a critically important aspect of dentistry. To this end, very high intensity lamps, such as quartz halogen type, are normally provided with dental lights. The lamps have sufficient intensity and color temperature to fully illuminate the mouth and accurately render tissue colors.

The light includes a housing. A generally convex shaped reflector is mounted in the housing to the rear of the lamp to reflect and focus the lamp's light on the face of the patient. Forward of the lamp, a transparent reflector shield is mounted to the light housing.

The dental patient's eyes must be protected from the intense light that illuminates the patient's mouth. To this end, shadow masks have been attached to dental lights for the purpose of casting a shadow over the patient's eyes. The shadow masks are generally cup-shaped members that are attached to the reflector shield, centered on the lamp, and sized to cast a sufficiently large shadow to protect the dental patient's eyes from exposure to the intense light.

The production of a reflector shield to incorporate a shadow mask complicates and adds expense to the manufacture of the dental light.

This invention is directed to a shadow mask for a dental light, which mask is a discrete component that is manufactured separately from the reflector shield and is easily and removably attached to the lamp socket to provide the necessary eye-protecting shadow.

The use of a discrete shadow mask greatly simplifies the manufacture of the reflector shield, which may be formed of a continuous piece of transparent material. Inasmuch as the shadow mask is not formed as an outwardly protruding part of the reflector shield, the outer surface of the reflector shield is a smooth, curved surface that is easy to clean.

The shadow mask includes legs that provide spring action to facilitate easy attachment (and removal) of the shadow mask to a lamp socket. The legs clip to the socket in a manner such that the mask is substantially immovable relative to the socket, hence the shadow mask is substantially immovable relative to the lamp.

DESCRIPTION OF PREFERRED EMBODIMENTS

Figure 1:
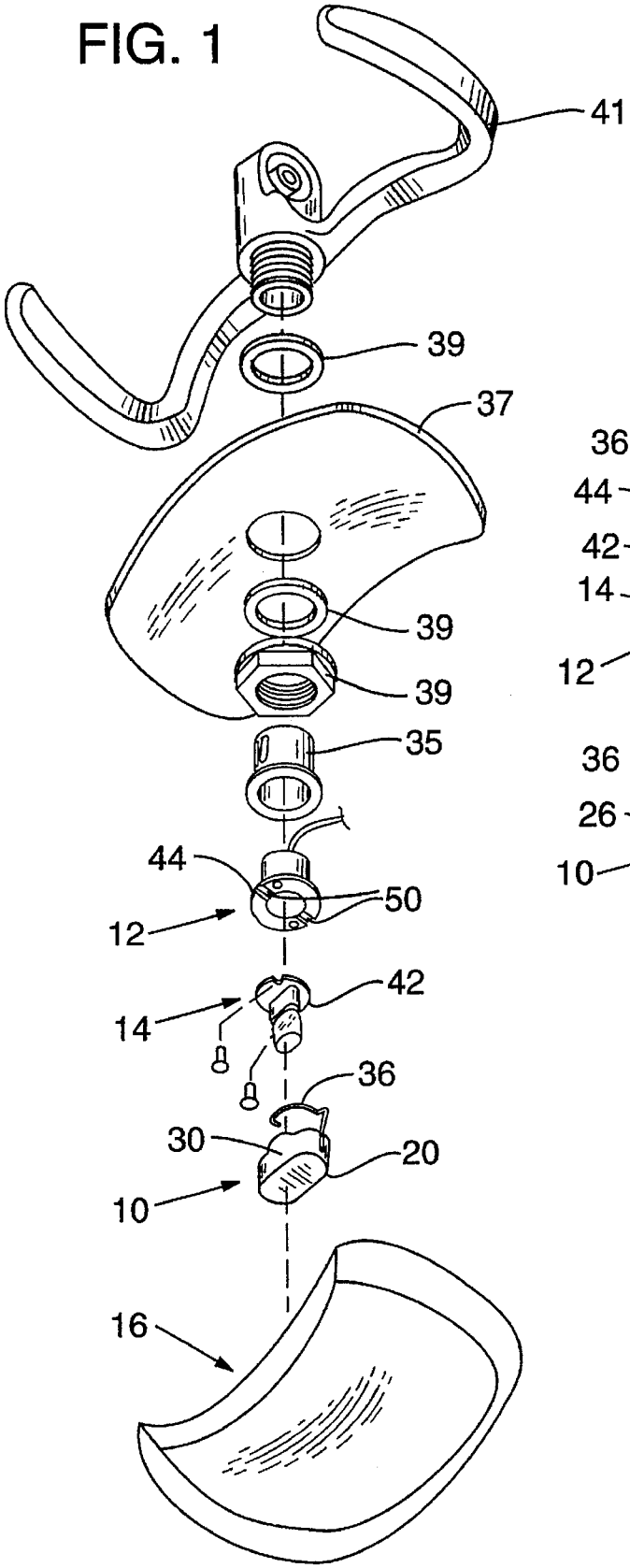
FIG. 1 is an exploded perspective view depicting the shadow mask assembly of the present invention.

Referring to FIGS. 1–4, there is shown the shadow mask assembly of the present invention depicted in conjunction with several of the components of a dental light. The assembly includes a shadow mask 10 that clips to a socket 12 that carries a lamp 14. The mask 10 is easily detached from the socket 12 and is a component separate from the reflector shield 16.

Other components of the light include a socket insulator 35, reflector 37 and suitable hardware 39 for attaching the lamp assembly to a movable lamp base 41. For clarity of illustration, the light housing has not been depicted.

Figure 3:
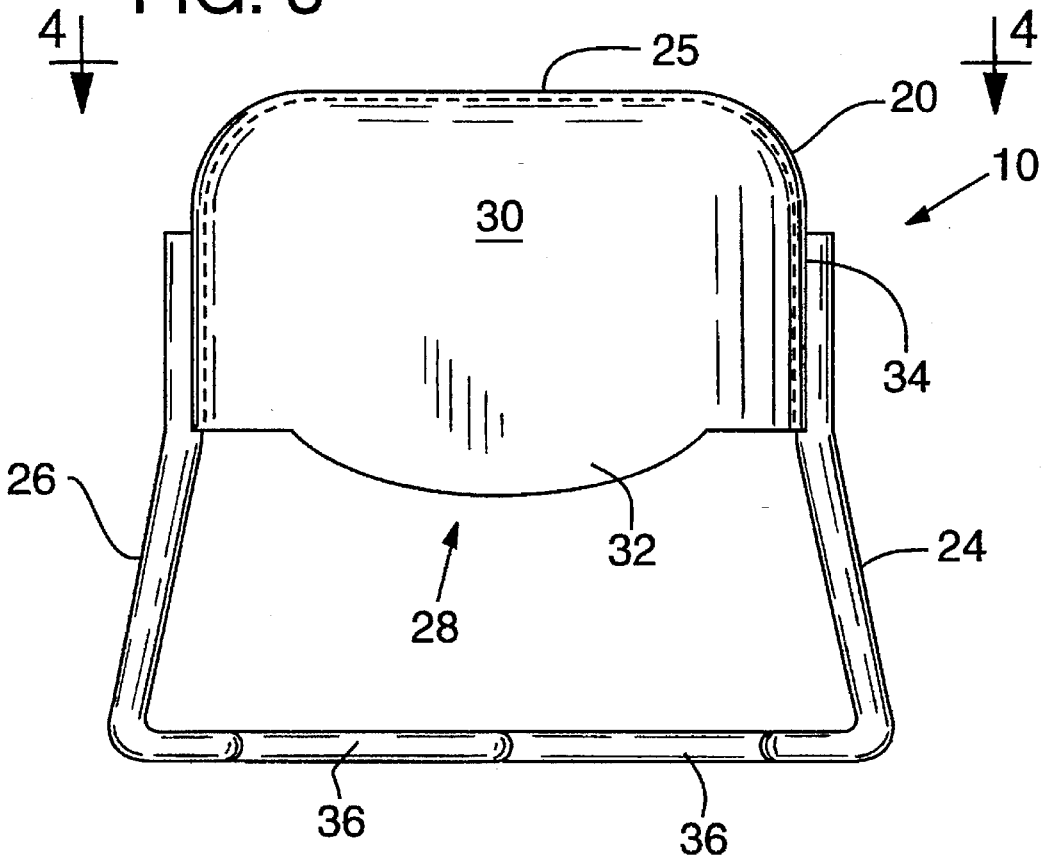
FIG. 3 is a side elevation view of the shadow mask part of the assembly.

The mask 10 comprises a cap 20 to which is attached a pair of protruding legs 24, 26. As viewed in FIG. 4, the cap 20 is a generally an elongated ellipse having a closed end 25 and an open end 28 (FIG. 3). The open end 28 faces the lamp 14 as described more fully below. The cap may be formed, for example, of thin-walled steel.

The two long sides 30 of the cap 20 each include a protruding, crescent-shaped ear 32 which, in conjunction with the remainder of the cap portion, define the shape of the shadow that covers the dental patient's eyes when the light is properly positioned.

The legs 24, 26 are attached to extend from the cap 20. As will be appreciated upon viewing FIGS. 3 and 4, the legs are generally symmetrical about the center of the cap, hence the configuration of only one leg 24 will be described with the understanding that the remaining leg 26 is substantially identical, and symmetrically arranged.

Figure 4:
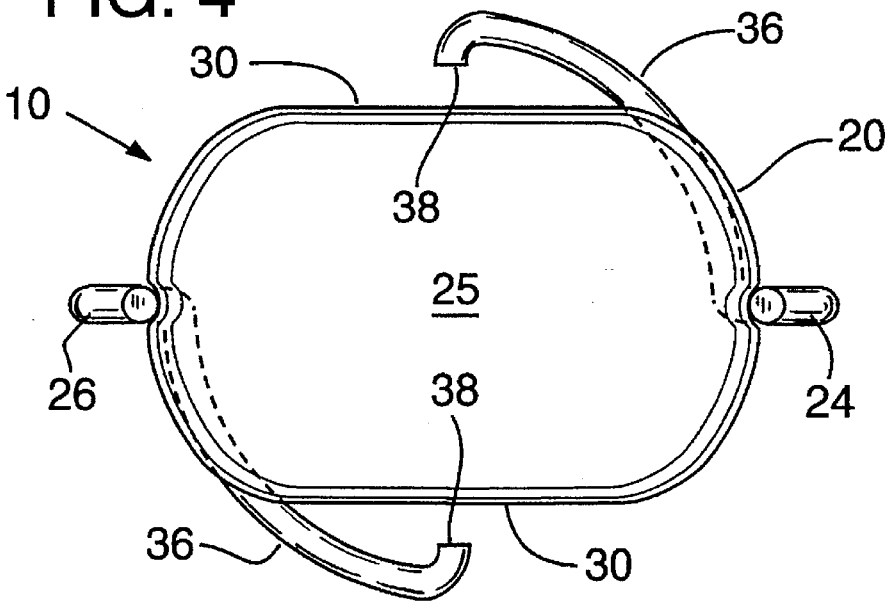
FIG. 4 is a view of the shadow mask taken along line 4—4 of FIG. 3.

The leg 24 is formed of substantially stiff but springy wire, one end of which is attached, as by soldering, to a groove 34 formed in the short, curved side of the cap. The leg 24 extends from the open end 28 of the cap and diverges outwardly as best seen in FIG. 4. The outermost portion of the leg 24 defines a generally arcuate-shaped part 36 that terminates in a foot 38. The foot 38 projects inwardly slightly toward the center of the mask as best shown in FIG. 4. As mentioned, the other leg 26 has an identically shaped arcuate part 36 and inwardly projecting foot 38. The arcuate parts 36 and feet 38 of both legs 24 and 26 are disposed in a common plane so that they fit into an annular groove as described next.

Figure 2:
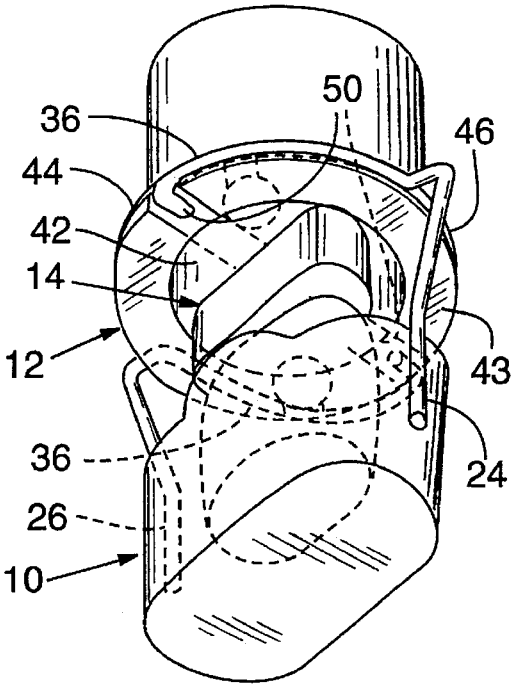
FIG. 2 is an enlarged, perspective view of the primary components of the assembly.

As best shown in FIG. 2, the base plate 42 of the lamp 14 is fastened to the flange 44 of the socket 12. The socket has a generally annular shaped groove 46 formed in the flange 44. Moreover, diametrically opposed notches 50 are also provided in the surface 43 of flange 44, contiguous with the annular groove 46.

In order to attach the shadow mask to the socket, the legs 24, 26 of the mask 10 are resiliently deformed by an amount sufficient to permit the arcuate parts 36 to snap into the groove 46 upon release. The projecting feet 38 fit into the diametrically opposed notches 50 (FIG. 2).

It will be appreciated that the legs 24, 26 are sized so that the shadow mask is held in place against the socket, unable to be moved toward or away from the socket unless the legs are again deformed to permit removal of the arcuate parts out of the groove 46. The extension of the feet 38 into the notches 50 limits rotation of the mask relative to the lamp 14 (which lamp has a generally elliptical cross-section corresponding to that of the cap 20) so that the position of the shadow mask remains unchanged relative to the lamp 14.

In view of the foregoing, it will be appreciated that the present invention provides an easy-to-attach shadow mask that is essentially snap-fit to a lamp socket and need not be manufactured in conjunction with the reflector shield, thereby reducing the expense and complexity of manufacturing the overall dental light.

Although the foregoing has been described in connection with preferred and alternative embodiments, it will be appreciated by one of ordinary skill in the art that various modifications may be substituted for the mechanisms and method described here without departing from the invention as defined by the appended claims and their equivalents. For example, it is contemplated that the shadow mask may be constructed with a single leg having an arcuate part of sufficient length to fit into the groove 46 and secure the mask.

The invention claimed is:

1. A shadow mask assembly for a dental light comprising:

a socket member adapted for securing a lamp, the socket member defining a groove; and a shadow mask, the mask including a cap having a leg connected thereto, the leg comprising a spring member, the spring member being deformable to snap into the groove to attach the mask to the socket member and prevent movement of the mask toward and away from the socket member.

2. The assembly of claim 1 wherein the mask includes two legs connected thereto, the legs being removably attachable to the socket member.

3. The assembly of claim 1 wherein the groove at least partially circumscribes the socket.

4. The assembly of claim 1 in which the leg attaches to the cap at a single location.

5. The assembly of claim 1 wherein the leg includes a foot and wherein the socket member further defines a notch into which fits the foot, thereby to limit the mask rotation relative to the socket member.

6. The assembly of claim 5 wherein the socket member has a face and wherein the notch is formed in the face and extends substantially centrally inward from the groove.

7. A shadow mask that is adapted for removable attachment to a socket of a lamp, comprising:

a cap; and at least one leg connected to extend from the cap, the leg terminating in a substantially straight foot part that clips onto the socket so that the cap is spaced from the socket thereby to permit a lamp that is connected to the socket to fit between the cap and the socket.

8. The mask of claim 7 wherein the mask includes two legs that define springs that are deformable for replaceably removing the mask from the socket.

* * * * *